United States Patent [19]

Ono et al.

[11] Patent Number: 5,052,361

[45] Date of Patent: Oct. 1, 1991

[54] METHOD OF DETECTING DETERIORATION OF AN EXHAUST GAS CONCENTRATION SENSOR FOR AN INTERNAL COMBUSTION ENGINE

[75] Inventors: Hiroshi Ono; Takashi Kiyomiya; Masahiko Yakuwa, all of Wako, Japan

[73] Assignee: Honda Giken Kogyo K.K., Tokyo, Japan

[21] Appl. No.: 535,842

[22] Filed: Jun. 11, 1990

[30] Foreign Application Priority Data

Jun. 15, 1989 [JP] Japan ..... 1-152848

[51] Int. Cl.[5] ..... F02D 41/14

[52] U.S. Cl. ..... 123/489; 73/23.32; 73/118.2

[58] Field of Search ..... 123/440, 479, 489, 589; 73/118.2, 23.31, 23.32; 60/276

[56] References Cited

U.S. PATENT DOCUMENTS 4,121,548 10/1978 Hattori et al. ..... 123/489 X
4,177,787 12/1979 Hattori et al. ..... 123/489 X
4,414,950 11/1983 Otsuka et al. ..... 123/440 X
4,624,232 11/1986 Saito et al. ..... 123/489
4,729,219 3/1988 Kayanuma et al. ..... 123/489 X
4,844,038 7/1989 Yamato et al. ..... 123/489 X
4,938,194 7/1990 Kato et al. ..... 123/489 X

FOREIGN PATENT DOCUMENTS 0205349 9/1986 Japan ..... 123/489
0126237 6/1987 Japan ..... 123/489

*Primary Examiner*—Willis R. Wolfe
*Attorney, Agent, or Firm*—Arthur L. Lessler

[57] ABSTRACT

Deterioration of an exhaust gas concentration sensor for an internal combustion engine is detected by integrating a difference between an output from the exhaust gas concentration sensor and a predetermined reference value which is outside a range of the output which can be assumed during normal operation of the exhaust gas concentration sensor, comparing a thus obtained integral value with a predetermined deterioration-determining value, and determining from the result of the comparision whether the exhaust gas concentration sensor is deteriorated.

7 Claims, 9 Drawing Sheets

$V_{O2}$ WAVEFORM

| | IDLING | CRUISING |
|---|---|---|
| NORMAL $O_2$ SENSOR |  |  |
| DETERIO – RATED $O_2$ SENSOR |  |  |

(RESULTS OF CALCULATIONS)

$V_{O2SQRAVESUM}$ = (①+②+③+④) /2

$V_{O2SQRAVEL}$ = (①+③) /2

$V_{O2SQRAVEH}$ = (②+④) /2

$V_{O2SQRL}$ = ①+③

$V_{O2SQRH}$ = ②+④

$V_{O2SQRSTK}$ = ⑤

$n_{WAVEL} = n_{WAVEH} = 2$

METHOD OF DETECTING DETERIORATION OF AN EXHAUST GAS CONCENTRATION SENSOR FOR AN INTERNAL COMBUSTION ENGINE

BACKGROUND OF THE INVENTION

This invention relates to a method of detecting deterioration of exhaust gas concentration sensors for internal combustion engines, which are used for the air-fuel ratio feedback control of the engines.

A typical conventional air-fuel ratio feedback control method for internal combustion engines is disclosed e.g. in Japanese Provisional Patent Publication (Kokai) No. 57-137633. According to this conventional method, a value of concentration of an exhaust gas component (oxygen) is sensed by an exhaust gas concentration sensor arranged in the exhaust system of the engine, and the sensed concentration value is compared with a predetermined reference value. By the use of an air-fuel ratio feedback control correction coefficient based on the result of the comparison, the air-fuel ratio of the mixture supplied to the engine is feedback controlled to a stoichiometric mixture ratio at which can be obtained the best conversion efficiency of a three-way catalyst arranged in the engine exhaust system, thereby improving the exhaust emission characteristics.

An $O_2$ sensor employed as the exhaust gas concentration sensor in the above system has a sensing element formed of zirconium oxide or the like. Utilizing the fact that the amount of oxygen ion which permeates the interior of zirconium oxide varies depending upon the difference between the partial pressure of oxygen in the atmosphere and the partial pressure of oxygen contained in the exhaust gases, the $O_2$ sensor senses the exhaust gas oxygen concentration and outputs a voltage which varies as a function of the above-mentioned variation of the permeation amount of oxygen dependent upon the partial pressure difference.

However, it is known that an $O_2$ sensor of the aforementioned construction has an output characteristic changing with the lapse of time of use. Particularly the sensor output characteristic deteriorates after a vehicle equipped with the sensor has been put through an endurance run, such that the controlled air-fuel ratio becomes richer in comparison with that exhibited at delivery of the vehicle from the factory, even through the feedback control of the air-fuel ratio is performed under the same conditions as at the delivery.

The deteoriorated $O_2$ sensor output characteristic adversely affects driveability, fuel consumption and exhaust emission characteristics of the engine unless any measures are taken to deal with this aging change in the $O_2$ sensor output characteristic. To this end, a method of detecting deterioration of an exhaust gas concentration sensor has already been proposed e.g. by Japanese Provisional Patent Publication (Kokai) No. 63-189638.

According to this publication, calcuation is made of a ratio of a value obtained by integrating output values from the exhaust gas concentration sensor from the time the output from the sensor is changed or inverted from a leaner side to a richer side with respect to a predetermined reference value to the time the output from same is changed from the richer side to the leaner side with respect to the predetermined reference value, to a value obtained by integrating output values from the sensor from the time the output from the sensor is changed from the richer side to the leaner side with respect to the predetermined reference value to the time the output from same is changed from the leaner side to the richer side with respect to the predetermined reference value. Based on the ratio thus calculated, the predetermined reference value is changed. Detection of deterioration of the sensor due to aging is effected based on the above ratio between the two integral values.

However, the waveform of the output (voltage) from the exhaust gas concentration sensor changes from a steeper one to a gentler one as aging of the sensor proceeds. More specifically, with aging of the sensor, the period of inversion of the output voltage $V_{02}$ becomes longer, and at the same time the amplitude of the output voltage becomes reduced. However, according to the above method, in which the deterioration of the $O_2$ sensor is determined by the above-mentioned ratio between the two integral values, the ratio can remain within a normal range even if the waveform of the output voltage becomes so gentle with aging of the sensor, which makes it impossible to accurately detect of deterioration of the $O_2$ sensor.

SUMMARY OF THE INVENTION

It is the object of the invention to provide a method of detecting deterioration of an exhaust gas concentration sensor of an internal combustion engine, which is capable of more accurately detecting the deterioration of the exhaust gas concentration sensor caused by aging.

To attain the above object, the present invention provides a method of detecting deterioration of an exhaust gas concentration sensor for an internal combustion engine, the exhaust gas concentration sensor detecting concentration of a component of exhaust gases emitted from the engine, the engine having control means responsive to an output from the exhaust gas concentration sensor for controlling an amount of fuel supplied to the engine.

The method according to the invention is characterized by comprising the steps of:

(1) integrating a difference between the output from the exhaust gas concentration sensor and a predetermined reference value which is outside a range of the output which can be assumed during normal operation of the exhaust gas concentration sensor;

(2) comparing a thus obtained integral value with a predetermined deterioration-determining value; and (3) determining from the result of the comparison whether the exhaust gas concentration sensor is deteriorated.

Preferably, the air-fuel ratio of a mixture containing the fuel supplied to the engine is determined by comparing the output from the exhaust gas concentration sensor with a predetermined lean/rich state-determining value, the integral value being obtained by integrating a difference between the predetermined reference value and values of the output on a side toward the predetermined reference value with respect to the predetermined lean/rich state-determining value.

Also preferably, the step (1) is carried out over a time period from the time point the output changes across the predetermined lean/rich state-determining value to the time point the output changes across the predetermined lean/rich state-determining value again.

More preferably, the predetermined reference value comprises a higher reference value higher than the predetermined lean/rich state-determining value, and a lower reference value lower than the predetermined lean/rich state-determining value, the integral value being obtained by integrating a difference between the higher reference value and values of the output from the exhaust gas concentration sensor when the output is higher than the predetermined predetermined lean/rich state-determining value, and by integrating a difference between the lower reference value and values of the output when the output is lower than the lean/rich state-determining value.

Preferably, calculation of the integral value is inhibited over a predetermined time period immediately after the output from the exhaust gas concentration sensor changes across the predetermined lean/rich state-determining value.

Preferably, an average value of a plurality of values of the integral value is obtained, the average value being compared with the predetermined deterioration-determining value to determine deterioration of the exhaust gas concentration sensor.

More preferably, a first average value of values of the integral value obtained by integrating the difference between the higher reference value and values of the output, and a second average value of values of the integral value obtained by integrating the difference between the lower reference value and values of the output, are obtained, the first and second average values being added together to obtain a sum thereof, the sum being compared with the predetermined deterioration-determining value.

The above and other objects, features, and advantages of the invention will become more apparent from the ensuing detailed description taken in conjunction with the accompanying drawings.

DETAILED DESCRIPTION

The method according to the invention will now be described in detail with reference to the drawings showing embodiments thereof.

Figure 1:
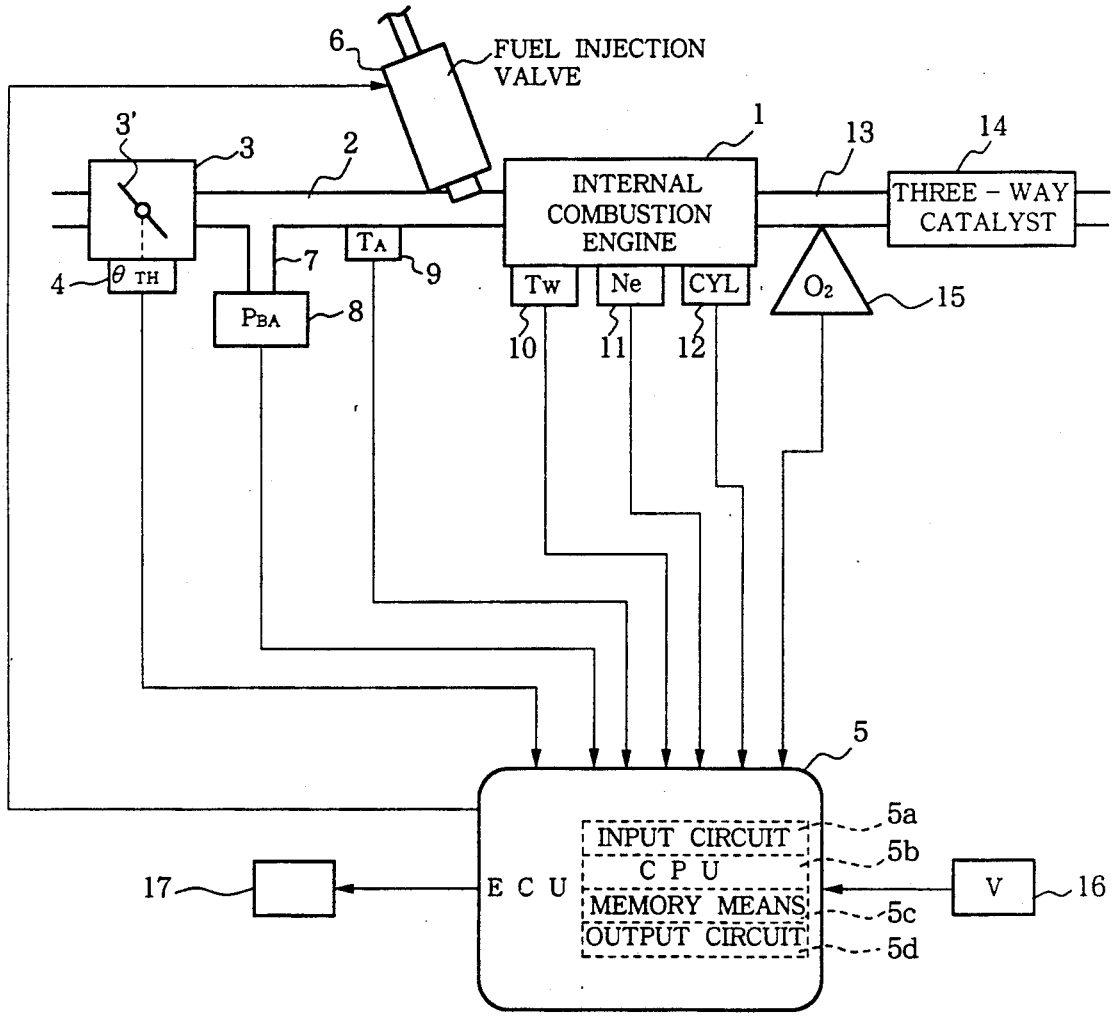
FIG. 1 is a schematic diagram showing the whole arrangement of a fuel supply control system of an internal combustion engine including an exhaust gas concentration sensor to which is applied the deterioration-detecting method according to the invention.

Referring first to FIG. 1, there is shown the whole arrangement of a fuel supply control system for an internal combustion engine including an exhaust gas concentration sensor ($O_2$ sensor) to which is applied the method according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 at a location immediately downstream of the throttle valve 3' for supplying an electric signal indicative of the sensed absolute pressure within the intake pipe 2 to the ECU 5. An intake air temperature ($T_A$) sensor 9 is inserted into the intake pipe 2 at a location downstream of the intake pipe absolute pressure sensor 8 for supplying an electric signal indicative of the sensed intake air temperature $T_A$ to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees if the engine is a four cylinder type, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas concentration sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration to the ECU 5. Connected to the ECU 5 is a vehicle speed (V) sensor 16 for detecting the speed of the vehicle and supplying a signal indicative of the detected vehicle speed thereto. Further electrically connected to the ECU 5 is an LED (light-emitting diode) 17 for giving warning when deterioration of the $O_2$ sensor 15 is detected by the method according to the invention described in detail hereinafter with reference to FIGS. 3*a* and 3*b*.

The ECU 5 comprises an input circuit 5a having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5b, memory means 5c storing various operational programs which are executed in the CPU 5b and for storing results of calculations therefrom, etc., and an output circuit 5d which outputs driving signals to the fuel injection valves 6.

The CPU 5b operates in response to the above-mentioned signals from the sensors to determine operating conditions in which the engine 1 is operating such as an air-fuel ratio feedback control region, in which the air-fuel ratio feedback control is carried out in response to detected concentration of oxygen in the exhaust gases, and open-loop control regions, and calculates, based upon the determined operating conditions, the valve opening period or fuel injection period $T_{OUT}$ over which the fuel injection valves 6 are to be opened, by the use of the following equation in synchronism with inputting of TDC signal pulses to the ECU 5.

$$T_{OUT}=T_i\times K_{02}\times K_1+K_2 \quad (1)$$

where $T_i$ represents a basic value of the fuel injection period $T_{OUT}$ of the fuel injection valves 6, which is read from a map set based upon the engine rotational speed Ne and the intake pipe absolute pressure $P_{BA}$.

$K_{O2}$ is an air-fuel ratio feedback control correction coefficient whose value is determined in response to the oxygen concentration in the exhaust gases detected by the $O_2$ sensor 15, during feedback control, while it is set to respective predetermined appropriate values while the engine is in predetermined operating regions (the open-loop control regions) other than the feedback control region. In addition, manners of setting the correction coefficient $K_{O2}$ based on the output voltage from the $O_2$ sensor are described in detail e.g. in aforementioned Japanese Provisional Patent Publication (Kokai) No. 63-189638.

$K_1$ and $K_2$ are other correction coefficients and correction variables, respectively, which are calculated based on various engine parameter signals to such values as to optimize characteristics of the engine such as fuel consumption and accelerability, depending on operating conditions of the engine.

The CPU 5b supplies through the output circuit 5d the fuel injection valves 6 with driving signals corresponding to the fuel injection period $T_{OUT}$ calculated as above, over which the fuel injection valves 6 are opened.

Figure 2A:
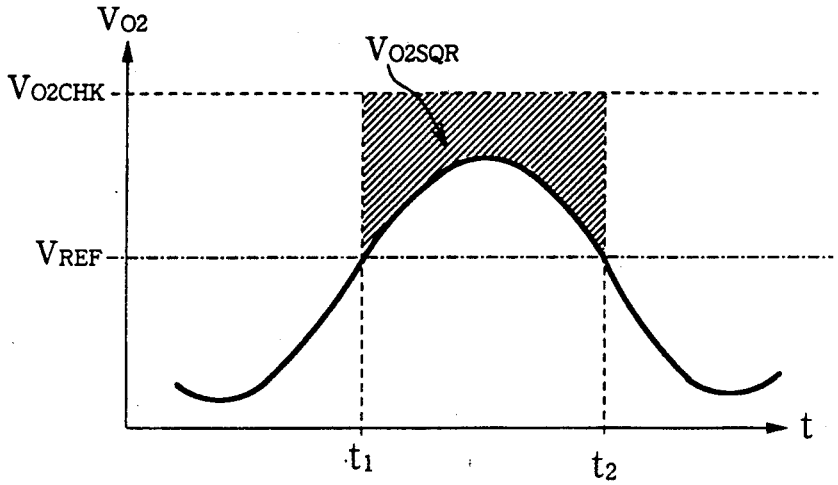
FIG. 2*a* is a diagram useful in explaining a manner of calculating an area value $V_{O2SQR}$ used for determining deterioration of the exhaust gas concentration sensor ($O_2$ sensor)
Figure 2B:
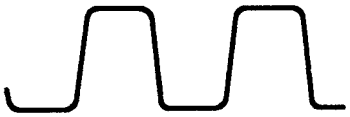
FIG. 2*b* is a table showing diagrams respectively showing waveforms of output voltage from a normal (non-deteriorated) $O_2$ sensor during idling and cruising of the engine in comparison with diagrams respectively showing waveforms of output voltage from a deteriorated $O_2$ sensor during idling and cruising of the engine.
Figure 2B:
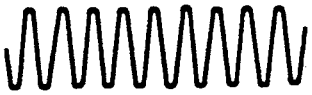
Figure 2B:
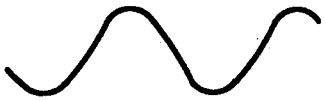
Figure 2B:
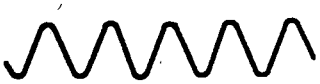

FIGS. 2a and 2b show waveforms of output voltage $V_{O2}$ from the $O_2$ sensor. FIG. 2a shows a manner of calculating an area value $V_{O2SQR}$ used for determining deterioration of the exhaust gas concentration sensor ($O_2$ sensor) according to a first embodiment of the invention. FIG. 2b shows waveforms of output voltage from a normal (non-deteriorated) $O_2$ sensor during idling and cruising of the engine in comparison with respective waveforms of output voltage from a deteriorated $O_2$ sensor during idling and cruising of the engine.

As shown in FIG. 2a, the area value $V_{O2SQR}$ for determining deterioration of the $O_2$ sensor is calculated by integrating absolute values of difference between the output voltage $V_{O2}$ from the $O_2$ sensor and a predetermined voltage (a predetermined reference value) $V_{O2CHK}$ from the time $t_1$ the output voltage $V_{O2}$ has exceeded a reference voltage $V_{REF}$ (a predetermined predetermined lean/rich state-determining value) and to the time $t_2$ the output voltage has then lowered to the reference voltage $V_{REF}$. The predetermined voltage $V_{O2CHK}$ is set to a value above the highest possible value of the output voltage $V_{O2}$ that can be assumed during normal operation of the $O_2$ sensor.

In the meanwhile, as shown in FIG. 2b, as aging of an $O_2$ sensor advances, irrespective of operating conditions of the engine, the waveform of the output voltage $V_{02}$ from the $O_2$ sensor decreases in amplitude, and at the same time the period of inversion of the output voltage $V_{02}$ increases so that the waveform changes from a steeper one to a gentler one. Therefore, as aging of the $O_2$ sensor proceeds, the absolute value of difference between the output voltage $V_{02}$ and the predetermined voltage $V_{02CHK}$ increases, and the time period of integration of the absolute value becomes longer, so that the calculated area value $V_{02SQR}$ increases as aging of the $O_2$ sensor preceeds.

Therefore, according to the first embodiment of the invention, deterioration of the $O_2$ sensor is determined by comparing the area value $V_{02SQR}$ with a predetermined deterioration-determining value SQRG.

Figure 3A:
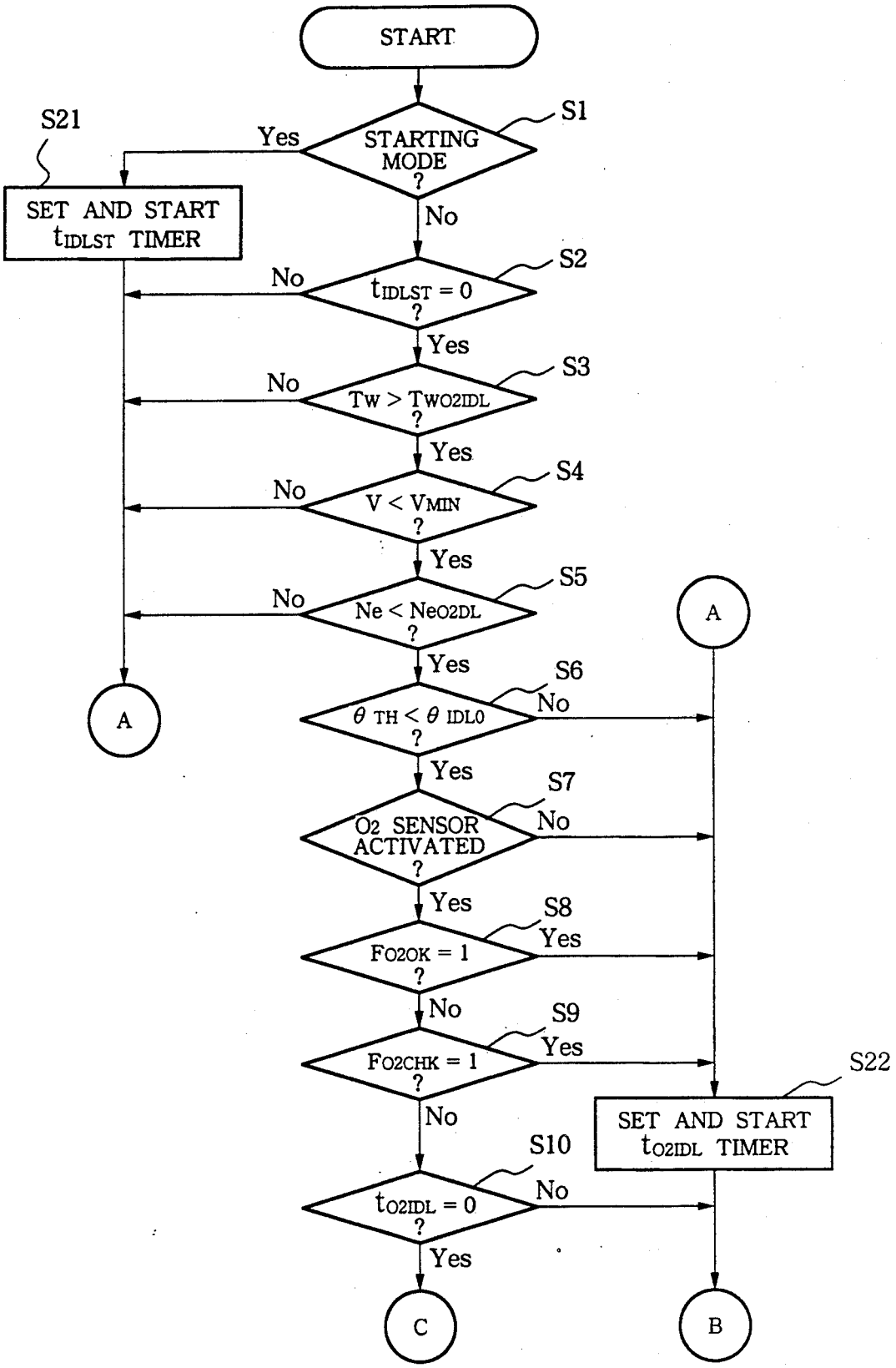
FIGS. 3*a* and 3*b* are flowcharts showing a program for detecting deterioration of the exhaust gas concentration sensor according to a first embodiment of the invention.
Figure 3B:
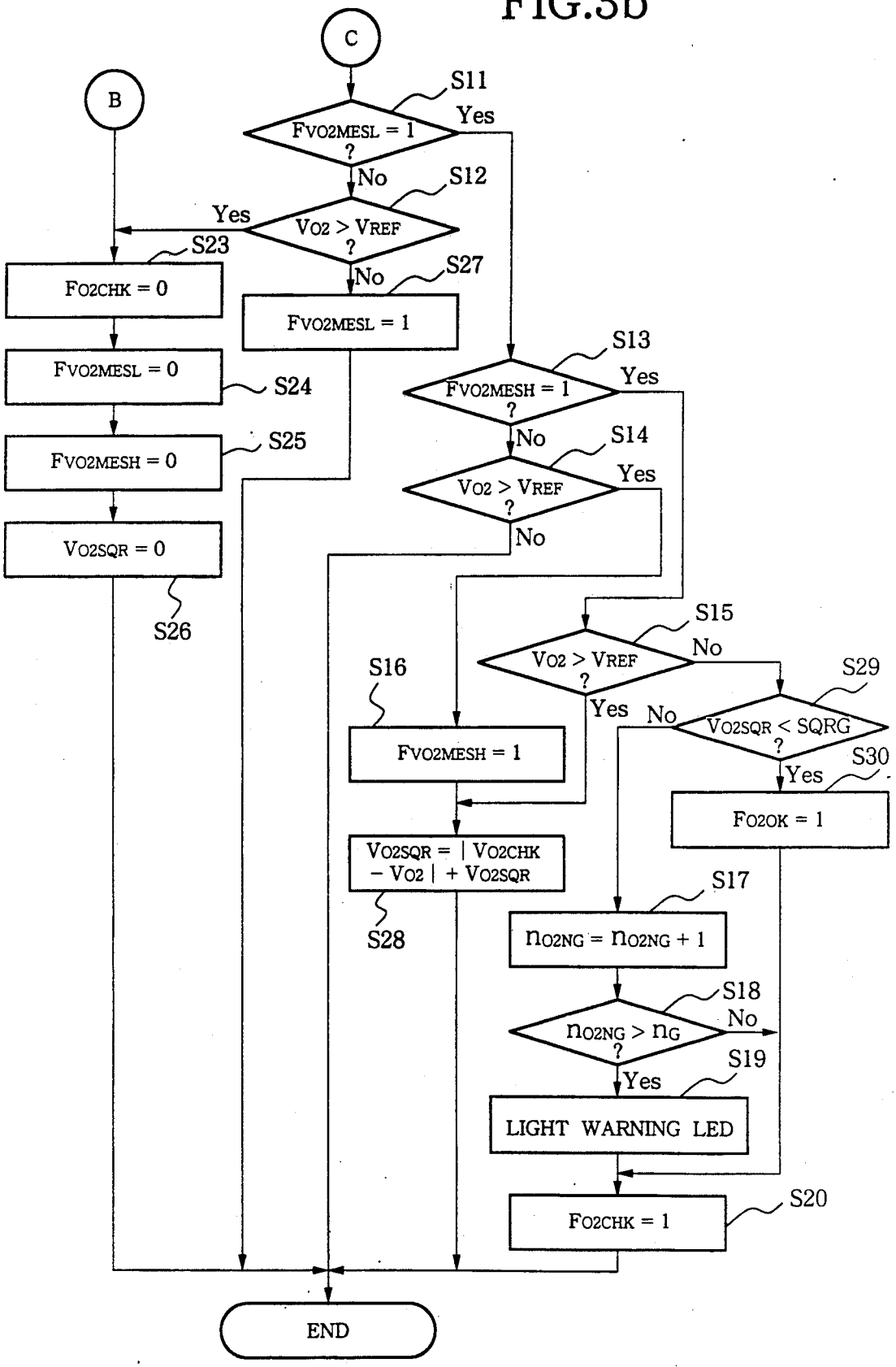

Next, FIGS. 3a and 3b show a program for detecting deterioration of the $O_2$ sensor by the method according to the first embodiment of the invention.

At a step S1, it is determined whether or not the engine is being started or cranked (e.g. whether or not the engine rotational speed is lower than a predetermined value to be assumed during starting of the engine). If the answer to this question is affirmative (Yes), i.e. if the engine is being started, a first timer (a $t_{IDLST}$ timer) is set to a predetermined value $t_{LDLST}$ (e.g. 2 seconds) and started at a step S21, and the program proceeds to a step S22. If the answer to the question of the step S1 is negative (No), it is determined at a step S2 whether or not the count value of the $t_{IDLST}$ timer is equal to 0. If the answer to this question is affirmative (Yes), i.e. a predetermined time period $t_{IDLST}$ has elapsed after completion of starting of the engine, it is determined at a step S3 whether or not the engine coolant temperature $T_W$ is higher than a predetermined value $T_{WO2IDL}$ (e.g. 80° C.). If the answer to this question is affirmative (Yes), i.e. if $T_W > T_{WO2IDL}$, it is determined at a step S4 whether or not the vehicle speed is lower than a predetermined value $V_{MIN}$ (e.g. 5 km/h). If the answer to this question is affirmative Yes), i.e. if $V < V_{MIN}$, it is determined at a step S5 whether or not the engine rotational speed Ne is lower than a predetermined value $Ne_{O2IDL}$ (e.g. 1,000 rpm). If the answer to this question is affirmative, i.e. $Ne < Ne_{O2IDL}$, it is determined at a step S6 whether or not the throttle valve opening $\theta_{TH}$ is smaller than a predetermined value $\theta_{IDLO}$ (e.g. 3 degrees). If the answer to this question is affirmative (Yes), i.e. if $\theta_{TH} < \theta_{IDLO}$, it is determined at a step S7 whether or not the $O_2$ sensor 15 has been activated (e.g. whether or not the output voltage $V_{O2}$ from the $O_2$ sensor has risen to a predetermined value). If the answer to this question is affirmative (Yes), i.e. if the $O_2$ sensor 15 has been activated), it is determined at a step S8 whether or not a third flag $F_{O2OK}$, referred to hereinafter, is equal to 1. If the answer to this question is negative (No), i.e. if $F_{O2OK}=0$, it is determined at a step S9 whether or not a fourth flag $F_{O2CHK}$, referred to hereinafter, is equal to 1.

If any of the answers to the questions of the steps S2 to S7 is negative (No), or if either of the answers to the questions of the steps S8 and S9 is affirmative (Yes), i.e. if any of the conditions of $t_{IDLST}>0$, $T_W \leqq T_{WO2IDL}$, $V \geqq V_{MIN}$, $Ne \geqq Ne_{O2IDL}$, $\theta_{TH} \geqq \theta_{IDLO}$, $F_{O2OK}=1$, and $F_{O2CHK}=1$, is satisfied, or if the $O_2$ sensor 15 has not been activated, a second timer (a $t_{O2IDL}$ timer) is set to a second predetermined value $t_{O2IDL}$ (e.g. 10 seconds) and started at the step S22, and then the program proceeds to a step S23. On the other hand, if all the answers to the questions of the steps S2 to S7 are affirmative (i.e., if all the conditions of $t_{IDLST}=0$, $T_W>T_{WO2IDL}$, $V<V_{MIN}$, $Ne<Ne_{O2IDL}$, and $\theta_{TH} \geqq \theta_{IDLO}$, are satisfied, and the $O_2$ sensor 15 has been activated), and if both of the answers to the questions of the steps S8 and S9 are negative (No) (i.e. $F_{O2OK}=0$, and $F_{O2CHK}=0$) (hereinafter referred to as "if the $O_2$ sensor-checking conditions are satisfied"), it is determined at a step S10 whether or not the count value of the $t_{O2IDL}$ timer is equal to 0. If the answer to this question is negative (No), i.e. if a second predetermined time period $t_{O2IDL}$ has not elapsed after the $O_2$ sensor-checking conditions became satisfied, the fourth flag $F_{O2CHK}$, first and second flags $F_{VO2MESL}$ and $F_{VO2MESH}$, and the area value $V_{O2SQR}$ are set to 0 at steps S23 to S26, respectively, followed by terminating the present program.

If the answer to the question of the step S10 is affirmative (Yes), i.e. if the second predetermined time period $t_{O2IDL}$ has elapsed after the $O_2$ sensor-checking conditions became satisfied, it is determined at a step S11 whether or not the value of the first flag $F_{VO2MESL}$ is equal to 1. If the answer to this question is negative, i.e. if $F_{VO2MESL}=0$, it is determined at a step S12 whether or not the output voltage $V_{O2}$ from the $O_2$ sensor 15 is higher than the reference voltage $V_{REF}$. If the answer to this question is affirmative (Yes), i.e. if $V_{O2}>V_{REF}$, the program proceeds to the step S23, whereas if the answer is negative (No), i.e. if $V_{O2} \leqq V_{REF}$, the first flag $F_{VO2MESL}$ is set to 1 at a step S27, followed by terminating the present program. Thus, the first flag $F_{VO2MESL}$ is set to 1 when the output voltage $V_{O2}$ from the $O_2$ sensor 15 is equal to or lower than the reference voltage $V_{REF}$.

If the answer to the question of the step S11 is affirmative (Yes), i.e. if $F_{VO2MESL}=1$, it is determined at a step S13 whether or not the value of the second flag $F_{VO2MESH}$ is equal to 1. If the answer to this question is negative (No), i.e. if $F_{VO2MESH}=0$, it is determined at a step S14, similarly to the step S12, whether or not the output voltage $V_{O2}$ from the $O_2$ sensor is higher than the reference voltage $V_{REF}$. If the answer to the question of the step S14 is negative (No), i.e. if $V_{O2} \leqq V_{REF}$, the present program is immediately terminated, whereas if the answer is affirmative (Yes), i.e. if $V_{O2}>V_{REF}$, the second flag $F_{VO2MESH}$ is set to 1 at a step S16.

Thus, the second flag $F_{VO2MESH}$ is set to 1 when the output voltage $V_{O2}$ from the $O_2$ sensor changes from a value equal to or lower than the reference voltage $V_{REF}$ (after setting the first flag $F_{VO2MESL}$ to 1) to a value higher than the reference voltage $V_{REF}$.

When it is determined at the step S14 that the output voltage $V_{O2}$ from the $O_2$ sensor has risen across the reference voltage $V_{REF}$ ($t_1$ in FIG. 2a), the second flag is set to 1 at the step S16, and the area value $V_{O2SQR}$ for determining deterioration of the $O_2$ sensor starts to be calculated at a step S28, in a manner as described hereinbefore with reference to FIG. 2a, by the following equation (2), followed by terminating the present program:

$$V_{O2SQR}=|V_{O2CHK}-V_{O2}|+V_{O2SQR} \quad (2)$$

where $V_{O2SQR}$ on the right side is an area value obtained up to the last loop.

If the answer to the question of the step S13 is affirmative (Yes), i.e. if $F_{VO2MESH}=1$, it is determined at a step S15, similarly to the steps S12 and S14, whether or not the output voltage $V_{O2}$ is higher than the reference voltage $V_{REF}$. If the answer to this question is affirmative (Yes), i.e. if $F_{VO2MESH}=1$ and $V_{O2}>V_{REF}$, in other words, if it is determined that the output voltage $V_{O2}$, which once exceeded the reference voltage (at $t_1$ in FIG. 2a), has not fallen to the reference voltage $V_{REF}$ again, i.e. the time has not reached $t_2$ in FIG. 2a, the calculation of the area value $V_{O2SQR}$ is continued at the step S28, followed by terminating the present program. On the other hand, if the answer to the question of the step S15 is negative (No), i.e. if the output voltage $V_{O2}$ has become equal to or lower than the reference voltage $V_{REF}$, the calculation of the area value $V_{O2SQR}$ is terminated, and it is determined at a step S29 whether or not the calculated area value $V_{O2SQR}$ is smaller than the predetermined deterioration-determining value SQRG. If the answer to this question is negative (No), i.e. if the area value $V_{O2SQR}$ for determining deterioration of the $O_2$ sensor is larger than the deterioration-determining value SQRG, this means, as explained with reference to FIGS. 2a and 2b, that the $O_2$ sensor is deteriorated. Then, at a step S17, the count value $\eta_{O2NG}$ of a counter for counting the number of times the deterioration of the $O_2$ sensor is detected is increased by an increment of 1, and then it is determined at a step S18 whether or not the count value $\eta_{O2NG}$ is larger than a predetermined value $\eta_G$ (e.g. five times). If the answer to this question is negative (No), i.e. if $\eta_{O2NG} \leqq \eta_G$, the fourth flag $F_{O2CHK}$ is set to 1 at a step S20, followed by terminating the present program. On the other hand, if the answer to the question of the step S18 is affirmative (Yes), i.e. if $\eta_{O2NG}>\eta_G$, it is determined that the $O_2$ sensor 15 is deteriorated, and the warning LED 17 is lighted at a step S19, followed by the program proceeding to the step S20.

Since the fourth flag $F_{O2CHK}$ is set to 1 at the step S20, once it is determined that the $O_2$ sensor is deteriorated as a result of checking of the area value $V_{O2SQR}$ obtained from the output voltage $V_{O2}$, checking of the output voltage $V_{O2}$ is no longer carried out even if all the answers to the questions of the steps S2 to S7 are affirmative (Yes) and at the same time the value of the third flag $F_{O2OK}$ is equal to 0 (see the step S9).

In addition, both the initial values of the third flag $F_{O2OK}$ and the count value $\eta_{O2NG}$ are set to 0.

According to the method of the invention described in detail with reference to FIGS. 3a and 3b, under predetermined operating conditions of the engine, the area value $V_{O2SQR}$ for determining deterioration of the $O_2$ sensor explained with reference to FIG. 2a is compared with the predetermined deterioration-determining value SQRG, and if the number of times the condition of $V_{O2SQR} \geqq SQRG$ is satisfied exceeds the predetermined number $\eta_G$, it is finally determined that the $O_2$ sensor is deteriorated, so that accurate detection of deterioration of the sensor can be carried out. Further, since the unit time for calculating the area value $V_{O2SQR}$ by integration is defined by a time interval from the time point the output voltage $V_{O2}$ from the $O_2$ sensor has risen across the reference voltage $V_{REF}$ to the time point the output voltage $V_{O2}$ has fallen to the reference voltage $V_{REF}$, detection of deterioration of the $O_2$ sensor 15 can be positively carried out in a simple manner by the use of the single predetermined reference value $V_{O2CHK}$ and the single equation (2).

Figure 4A:
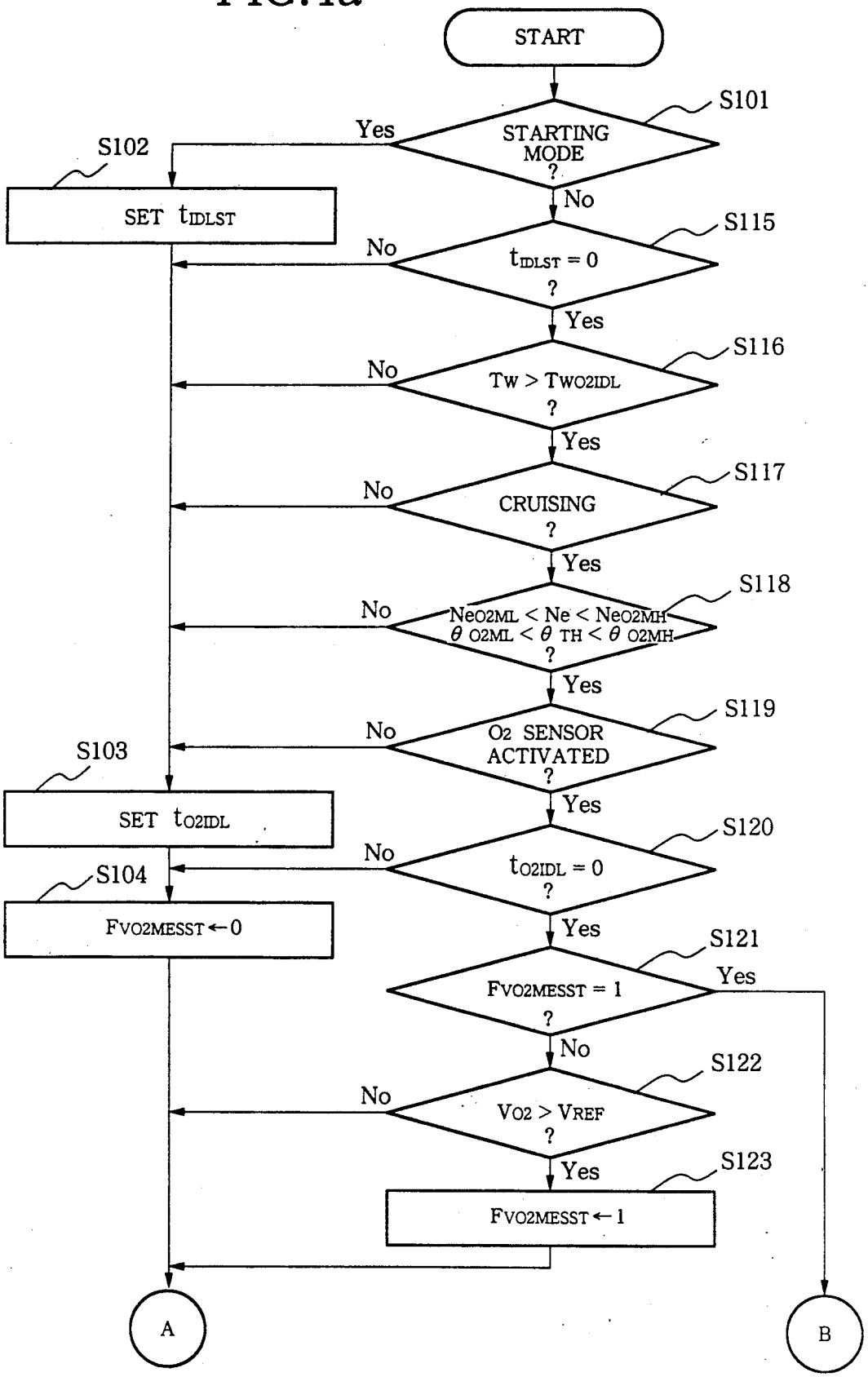
FIGS. 4*a* to 4*d* are flowcharts showing a program for detecting deterioration of the exhaust gas concentration sensor according to a second embodiment of the invention.
Figure 4B:
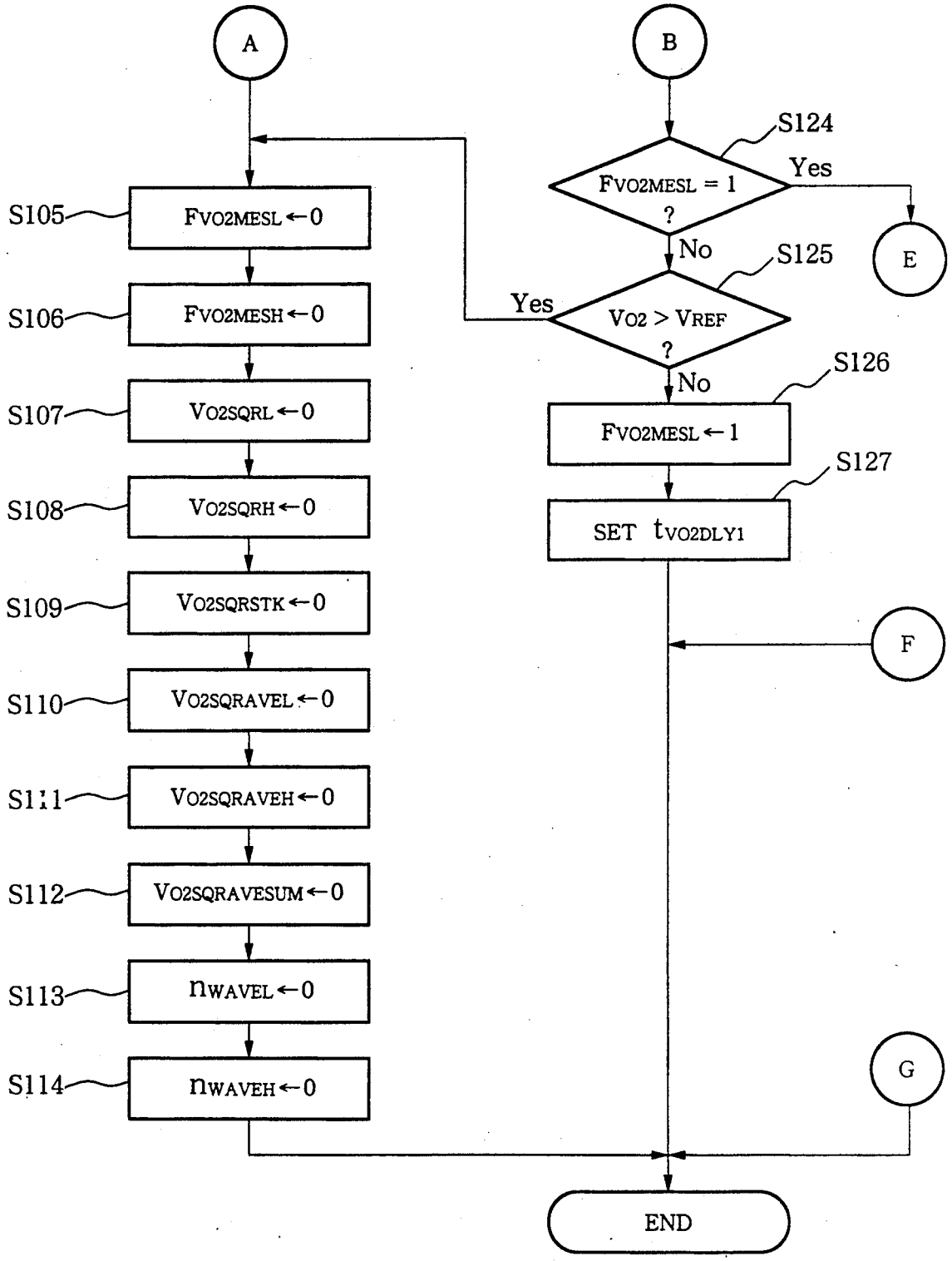
Figure 4C:
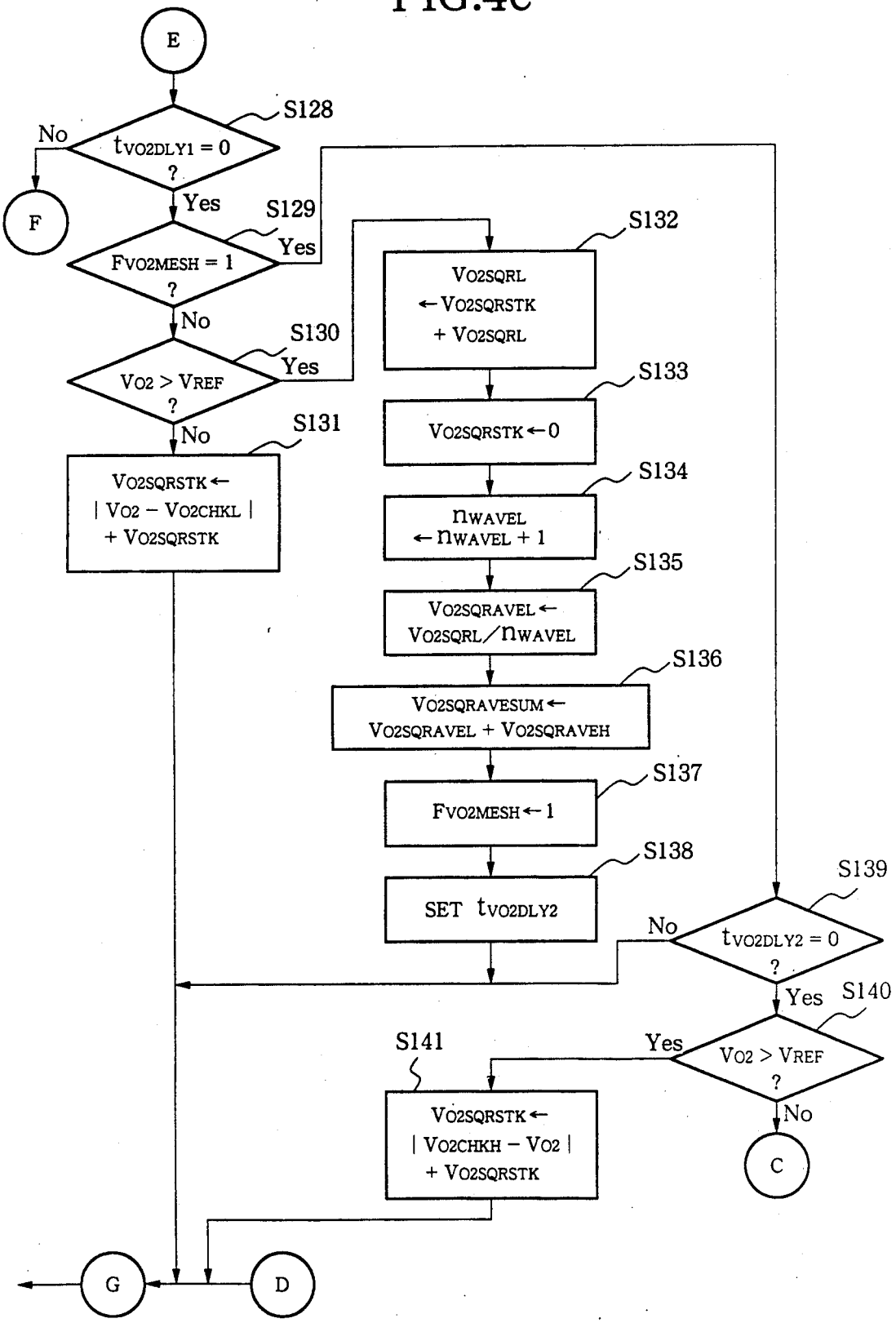
Figure 4D:
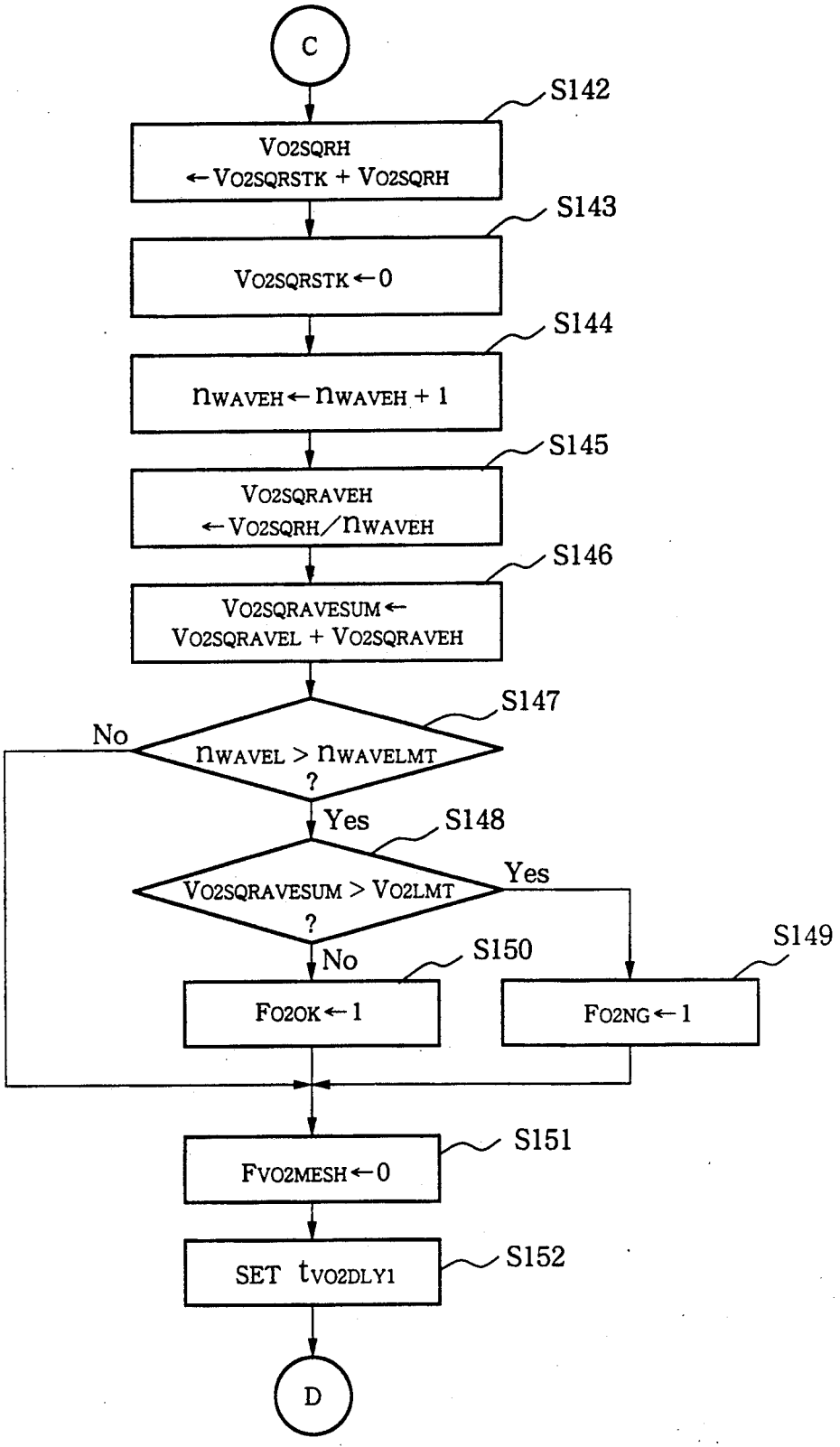

Further, in the above described embodiment, an average value of a plurality of values of the area value $V_{O2SQR}$ may be compared with the predetermined deterioration-determining value SQRG in a manner similar to that described hereinafter by steps S113, S114, S134 and S147 in FIGS. 4*b*, 4*c*, and 4*d* according to a second embodiment of the invention.

Next, the second embodiment of the invention will be described with reference to FIGS. 4*a* to 4*d* which show another program for detecting deterioration of the $O_2$ sensor. This program is executed whenever each of clock pulses having a period of e.g. 20 ms is generated.

First, at a step S101, it is determined whether or not the engine 1 is being started or cranked. If the answer to this question is affirmative (Yes), a $t_{IDLST}$ timer, which is formed by a down counter for counting down a time period which elapses after the engine 1 has shifted from a starting mode to a normal operation mode, is set to a predetermined value $t_{IDLST}$ (e.g. 1 second) at a step S102, and then a $t_{O2IDL}$ timer, which is formed by a down counter for counting down a time period which elapses after the $O_2$ sensor has been activated, is set to a predetermined time period $t_{O2IDL}$ (e.g. 2 seconds) at a step S103. Further, at steps S104 to S114, flags $F_{VO2MESST}$, $F_{VO2MESL}$, and $F_{VO2MESH}$, area values $V_{O2SQRL}$, $V_{O2SQRH}$, $V_{O2SQRSTK}$, $V_{O2SQRAVEL}$, $V_{O2SQRAVEH}$, and $V_{O2SQRAVESUM}$, and count values $\eta_{WAVEL}$ and $\eta_{WAVEH}$ are initialized, respectively, followed by terminating the present program.

On the other hand, if the answer to the question of the step S101 is negative (No), it is determined at a step 115 whether or not the count value of the $t_{IDLST}$ timer is qual to 0. If the answer to this question is negative (No), i.e. if a predetermined time period $t_{IDLST}$ has not elapsed after the engine 1 shifted from the starting mode to the normal operation mode, the program proceeds to the step S103, whereas if the answer is affirmative (Yes), the program proceeds to a step S116.

At the step S116, it is determined whether or not the engine coolant temperature $T_W$ is higher than a predetermined value $T_{WO2IDL}$ (e.g. 70° C.). Further, at a step S117, it is determined whether or not the vehicle is cruising, and at a step S118, it is determined whether or not the engine rotational speed Ne is within a predetermined range and at the same time the throttle valve opening $\theta_{TH}$ is within a predetermined range. The determination at the step S117 is effected by determining whether or not a rate of change in the vehicle speed V has continued to be lower than a predetermined value over a predetermined time period. Further, the determination at the step S118 is effected by determining whether or not the engine rotational speed Ne is between a lower limit value $Ne_{O2ML}$ (e.g. 500 rpm) and an upper limit value $Ne_{O2MH}$ (e.g. 2,000 rpm), and whether or not the throttle valve opening $\theta_{TH}$ is between a lower limit value $\theta_{O2ML}$ (e.g. 0 degree) and an upper limit value $\theta_{O2MH}$ (e.g. 4 degrees).

If any of the answers to the questions of the steps S116 to S118 is negative (No), it is judged that the operating condition of the engine is not suitable for detecting deterioration of the $O_2$ sensor, and the program proceeds to the step S103, whereas if all the answers to the questions of the steps S116 to S118 are affirmative (Yes), i.e. if the engine coolant temperature $T_W$ is higher than the predetermined value $T_{WO2IDL}$, the vehicle is cruising, and both the engine rotational speed Ne and the throttle valve opening $\theta_{TH}$ are within the respective predetermined ranges, the program proceeds to a step S119.

At the step S119, it is determined whether or not the $O_2$ sensor has been activated, and at a step S120, it is determined whether or not the count value of the $t_{O2IDL}$ timer is equal to 0. If the $O_2$ sensor 15 has not been activated (the answer to the question of the step S119 is negative (No)), the program proceeds to the step S103, and if a predetermined time period $t_{O2IDL}$ has not elapsed after the $O_2$ sensor became activated (the answer to the question of the step S119 is affirmative (Yes) and the answer to the question of the step S120 is negative (No)), the program proceeds to the step S104. If the predetermined time period $t_{O2IDL}$ has elapsed after the $O_2$ sensor became activated (both the answers to the questions of the steps S119 and S120 are affirmative (Yes)), the program proceeds to a step S121.

At the step S121, it is determined whether or not the flag $F_{VO2MESST}$ is equal to 1. Since the flag $F_{VO2MESST}$ was initially set to 0 at the step S104, the answer to the question of the step S121 is negative (No) this time, and therefore the program proceeds to a step S122.

At the step S122, it is determined whether or not the output voltage $V_{O2}$ from the $O_2$ sensor 15 is higher than a reference voltage $V_{REF}$ as the predetermined lean/rich state-determining value. If the answer to this question is negative (No), the program proceeds to the step S105, whereas if the answer is affirmative (Yes), the program proceeds to a step S123, where the flag $F_{VO2MESST}$ is set to 1, and then the program proceeds to the step 105. In other words, the flag $F_{VO2MESST}$ is set to 1 when the output voltage $V_{O2}$ has exceeded the reference voltage $V_{REF}$ for the first time after the $O_2$ sensor-checking conditions were satisfied, i.e. at a time point P1 in the graph of FIG. 5.

Once the flag $F_{VO2MESST}$ is set to 1, the answer to the question of the step S121 in the next loop becomes affirmative (Yes), and therefore the program proceeds to a step S124, where it is determined whether the flag $F_{VO2MESL}$ is equal to 1. Since the flag $F_{VO2MESL}$ was initially set to 0 at the step S105, the answer to the question of the step S124 is negative (No) this time, and therefore the program proceeds to a step S125, where it is determined whether or not the output voltage $V_{O2}$ from the $O_2$ sensor 15 is higher than the reference voltage $V_{REF}$. If the answer to this question is affirmative (Yes), the program proceeds to the step S105, whereas if the answer is negative (No) (at a time point P2 in the graph of FIG. 5), the program proceeds to steps S126 and S127.

At the step S126, the flag $F_{VO2MESL}$ is set to 1, and at the step S127, a $t_{VO2DLY1}$ timer, which is formed by a down counter for delaying the start of calculation of an area value on the lower side, is set to a predetermined time period (e.g. 0.1 second), followed by terminating the present program. The steps S124 to S126 are provided so that the calculation of the area value on the lower side may be started in the first place at steps S128 et seq.

Once the flag $F_{VO2MESL}$ has been set to 1, the answer to the question of the step S124 becomes affirmative (Yes) in the following loop, and the program proceeds to the step S128. At the step S128, it is determined whether or not the count value of the $t_{VO2DLY1}$ timer is equal to 0. If the answer to this question is negative (No), the program is terminated, whereas if the answer is affirmative (Yes) (at a time point P3 in the graph of FIG. 5), the program proceeds to a step S129. Thus, the step S128 inhibits execution of steps S129 et seq until the predetermined time period $t_{VO2DLY1}$ elapses after the time point $P_2$.

At the step S129, it is determined whether or not the flag $F_{VO2MESH}$ is equal to 1. Since this flag was initially set to 0 at the step S106, the answer to the question of the step S129 is negative (No) this time, and the program proceeds to a step S130, where it is determined whether or not the output voltage $V_{O2}$ from the $O_2$ sensor 15 is higher than the reference voltage $V_{REF}$.

Figure 5:
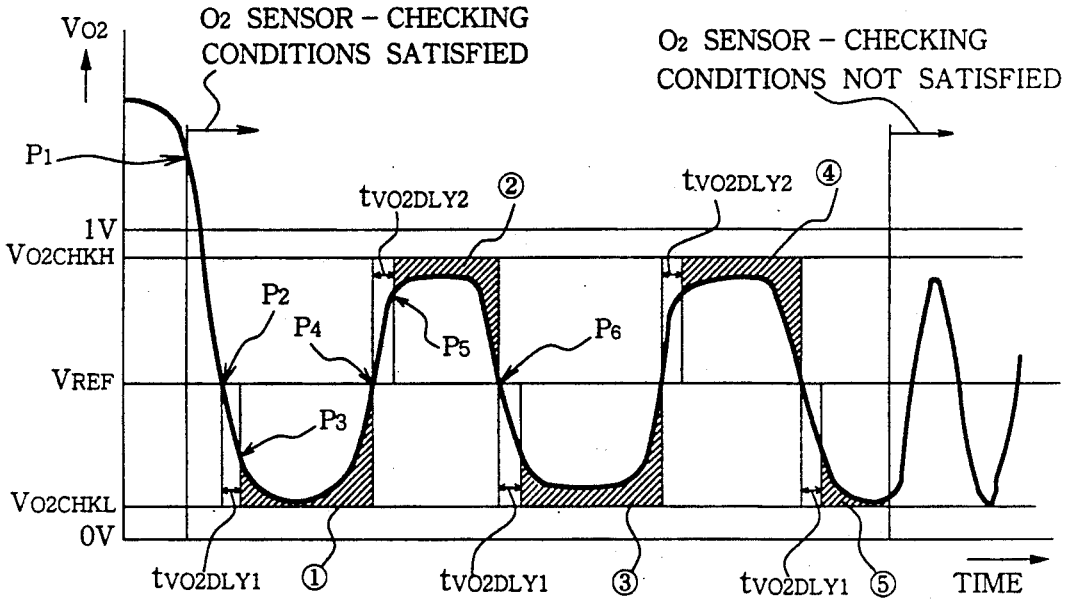
FIG. 5 is a diagram showing a change in the output voltage from an exhaust gas concentration sensor, which is useful in explaining the manner of detecting deterioration of the sensor according to the second embodiment.

Since the answer to the question of the step S130 is negative (No) immediately after the time point P3 in the graph of FIG. 5, the program proceeds to a step S131 this time. At the step S131, there is calculated an absolute value $|V_{O2}-V_{O2CHKL}|$ of difference between the output voltage $V_{O2}$ and a predetermined lower voltage $V_{O2CHKL}$ as a predetermined reference value which is lower than the lowest possible value of the $V_{O2}$ that can be assumed during normal operation of the $O_2$ sensor 15, and the calculated absolute value is added to a value of an indefinite absolute value $V_{O2SQRSTK}$ obtained in the immediately preceding loop to obtain a present value of the indefinite absolute value $V_{O2SQRSTK}$. Specifically, the indefinite absolute value $V_{O2SQRSTK}$ is a value of an area on the upper or lower side with respect to the reference voltage $V_{REF}$ obtained midway through calculation. For instance, it corresponds to a value of the area value which is obtained by integration of the area value which is started at the time point P3 in the graph of FIG. 5, at any time intermediate between the time point P3 and a time point P4 in same. After execution of the step S131, the present program is terminated.

When the answer to the question of the step S130 becomes affirmative (Yes) (at the time point P4 in the graph of FIG. 5), the integration of the value of an area (hatched portion 1 in the graph of FIG. 5) on the lower side with respect to the reference voltage $V_{REF}$ is completed. Then, the program proceeds from the step 130 to steps S132 to S138, to carry out averaging of the values of areas on the lower side and calculation of an average value of areas on the upper side and on the lower side. Specifically, at the step S132, the indefinite area value $V_{O2SQRSTK}$ obtained at the step S131 is added to an immediately preceding value of a definite total area value $V_{O2SQRL}$ on the lower side to obtain a present value of the definite total area value $V_{O2SQRL}$ on the lower side, and at a step S133, the indefinite area value $V_{O2SQRSTK}$ is initialized. The count value $\eta_{WAVEL}$, which indicates the number of areas on the lower side, the values of which were added to obtain the definite total area value $V_{O2SQRL}$, is increased by 1 at a step S134, and the definite total area value $V_{O2SQRL}$ on the lower side is divided by the increased count value $\eta_{WAVEL}$ to obtain an average value $V_{O2SQRAVEL}$ of the lower side area values at a step S135. The obtained average value $V_{O2SQRAVEL}$ of the lower side area values is added to an average value $V_{O2SQRAVEH}$ of the upper side area values to obtain an average value $V_{O2SQRAVESUM}$ of total areas on the lower and upper sides at a step S136. Then, the flag $F_{VO2MESH}$ is set to 1 at a step S137 to make preparations for calculation of an area value on the upper side to be carried out in the following loops. Further, a $t_{VO2DLY2}$ timer, which is formed by a down counter for delaying the start of calculation of the area value on the upper side, is set to a predetermined time period $t_{VO2DLY}$ (e.g. 0.1 second) at a step S138, followed by terminating the present program. The $t_{VO2DLY1}$ and $t_{VO2DLY2}$ timers are provided in order to prevent the calculated area values on the lower side and the upper side from fluctuating due to noise in signals supplied to the fuel supply control system when the output voltage $V_{O2}$ is in the vicinity of the reference voltage $V_{REF}$. To this end, these timers inhibit calculation of area values over a predetermined time period immediately after the output voltage $V_{O2}$ has increased or decreased across the referance voltage $V_{REF}$.

Once the flag $F_{VO2MESH}$ is set to 1, the answer to the question of the step S129 becomes affirmative (Yes) in the following loop, and therefore the program proceeds therefrom to a step S139. At the step S139, it is determined whether or not the count value of the $t_{VO2DLY2}$ timer is equal to 0. If the answer to this question is negative (No), the present program is terminated, whereas if the answer is affirmative (Yes) (at a time point P5 in the graph of FIG. 5), the program proceeds to a step S140.

At the step S140, it is determined whether or not the output voltage $V_{O2}$ is higher than the reference voltage $V_{REF}$. Since the answer to this question is affirmative immediately after the time point P5 in the graph of FIG. 5, the program proceeds to a step S141. At the step S141, the indefinite area value $V_{O2SQRSTK}$ is calculated in a manner similar to the step S131. However, in this case, the predetermined lower voltage $V_{O2CHKL}$ as a predetermined reference value should be replaced by a predetermined higher voltage $V_{O2CHKH}$ as a predetermined reference value.

The value of an area on the upper side (a hatched potion 2 in the graph of FIG. 5) is calculated by integration at the step S141 until the answer to the question of the step S140 becomes negative (No) (at a time point P6 in the graph of FIG. 5), and thereafter the program proceeds to steps S142 to S145, where averaging of of the values of areas on the upper side is carried out in a manner similar to the steps S132 to S135, provided that the definite total area value $V_{O2SQRL}$ on the lower side is replaced by a definite total area value $V_{O2SQRH}$ on the higher side, the count value $\eta_{WAVEL}$ is replaced by a count value $\eta_{WAVEH}$, which indicates the number of areas on the upper side, the values of which were added to obtain the definite total area value $V_{O2SQRH}$, and the average value $V_{O2SQRAVEL}$ of the lower side area values is replaced by an average value $V_{O2SQRAVEH}$ of the higher side area values. At the following step S146, the average value $V_{O2SQRAVESUM}$ of total areas on the lower and upper sides is calculated in a manner similar to the step S136.

Then, at the following steps S147 to S150, determination of deterioration of the $O_2$ sensor 15 is carried out based on the average value $V_{O2SQRAVESUM}$ of total areas on the lower and upper sides calculated at the step S146. Specifically, first at the step S147, it is determined whether or not the count value $\eta_{WAVEL}$ of the number of the lower side areas is larger than a predetermined value $\eta_{WAVELMT}$ (e.g. 3). This determination may be carried out by the count value $\eta_{WAVEH}$ of the number of the higher side areas, instead. If the answer to this question is negative (No), the program skips over steps S148 to S150, whereas if the answer becomes affirmative (Yes), it is determined at the step S148 whether or not the average value $V_{O2SQRAVESUM}$ is larger than a predetermined deterioration-determining value $V_{O2LMT}$. If the answer to this question is affirmative (Yes), it is judged that the $O_2$ sensor 15 is deteriorated, and at a step S149, a flag $F_{O2NG}$ is set to 1 to thereby indicate deterioration of the $O_2$ sensor 15, and warning of $O_2$ sensor deterioration is given by energizing the LED 17. On the other hand, if the answer to the question of the step S148 is negative (No), it is judged that the $O_2$ sensor 15 is normal, and at a step S150, the flag $F_{O2OK}$ is set to 1 to thereby indicate normality of the $O_2$ sensor 15.

Then, the program proceeds to a step S151, where the flag $F_{VO2MESH}$ is set to 0, and the $t_{VO2DLY1}$ timer is set to the predetermined value $t_{VO2DLY1}$ at a step S152, followed by terminating the present program. Since the steps S151 and S152 are thus executed, and the flag $F_{VO2MESL}$ remains 1, the steps S128 et seq are carried out in the following loops so long as the $O_2$ sensor-checking conditions are satisfied, to thereby continue calculation of area values after the time point P6 in the graph of FIG. 5.

As described above, according to the second embodiment of the invention, calculation of the area value is carried out with respect to a plurality of areas on each of the upper and lower sides, and therefore deterioration of the $O_2$ sensor can be more accurately detected, and further, the provision of the delaying time periods $t_{VO2DLY1}$ and $t_{VO2DLY2}$ can prevent erroneous determinations at the steps S125 and S130 due to noise, so that deterioration of the $O_2$ sensor can be more accurately detected.

What is claimed is:

1. A method of detecting deterioration of an exhaust gas concentration sensor for an internal combustion engine, said exhaust gas concentration sensor detecting concentration of a component of exhaust gases emitted from said engine, said engine having control means responsive to an output from said exhaust gas concentration sensor for controlling an amount of fuel supplied to said engine, the method comprising the steps of:

(1) integrating a difference between said output from said exhaust gas concentration sensor and a predetermined reference value which is outside a range of said output which can be assumed during normal operation of said exhaust gas concentration sensor;

(2) comparing a thus obtained integral value with a predetermined deterioration-determining value; and (3) determining from the result of said comparison whether said exhaust gas concentration sensor is deteriorated.

2. A method according to claim 1, wherein the air-fuel ratio of a mixture containing said fuel supplied to said engine is determined by comparing said output from said exhaust gas concentration sensor with a predetermined lean/rich state-determining value, said integral value being obtained by integrating a difference between said predetermined reference value and values of said output on a side toward said predetermined reference value with respect to said predetermined lean/rich state-determining value.

3. A method according to claim 2, wherein said step (1) is carried out over a time period from the time point said output changes across said predetermined lean/rich state-determining value to the time point said output changes across said predetermined lean/rich state-determining value again.

4. A method according to claim 2 or 3, wherein said predetermined reference value comprises a higher reference value higher than said predetermined lean/rich state-determining value, and a lower reference value lower than said predetermined lean/rich state-determining value, said integral value being obtained by integrating a difference between said higher reference value and values of said output from said exhaust gas concentration sensor when said output is higher than said predetermined lean/rich state-determining value, and by integrating a difference between said lower reference value and values of said output when said output is lower than said predetermined lean/rich state-determining value.

5. A method according to claim 4, wherein calculation of said integral value is inhibited over a predetermined time period immediately after said output from said exhaust gas concentration sensor changes across said predetermined lean/rich state-determining value.

6. A method according to claim 1, wherein an average value of a plurality of values of said integral value is obtained, said average value being compared with said predetermined deterioration-determining value to determine deterioration of said exhaust gas concentration sensor.

7. A method according to claim 4, wherein a first average value of values of said integral value obtained by integrating said difference between said higher reference value and values of said output, and a second average value of values of said integral value obtained by integrating said difference between said lower reference value and values of said output, are obtained, said first and second average values being added together to obtain a sum thereof, said sum being compared with said predetermined deterioration-determining value.

* * * * *